United States Patent [19]

Arndt

[11] Patent Number: 4,998,192

[45] Date of Patent: Mar. 5, 1991

[54] LAMP WITH GUARD

[75] Inventor: Michael A. Arndt, Franklin, Wis.

[73] Assignee: Adjustable Fixture Co., Milwaukee, Wis.

[21] Appl. No.: 521,247

[22] Filed: May 9, 1990

[51] Int. Cl.[5] ..... F21V 15/00

[52] U.S. Cl. ..... 362/376; 362/414; 362/437

[58] Field of Search ..... 362/291, 292, 311, 376, 362/378, 410, 412, 414, 435, 437

[56] References Cited

U.S. PATENT DOCUMENTS

| | | | |
|---|---|---|---|
| 2,138,373 | 11/1938 | Doane | 362/414 X |
| 2,469,412 | 5/1949 | Roebken | 362/376 X |
| 4,293,899 | 10/1981 | Sanner | 362/414 X |

*Primary Examiner*—Stephen F. Husar

*Attorney, Agent, or Firm*—Michael, Best & Friedrich

[57] ABSTRACT

A lamp includes a support for a socket and a generally parabolic diffuser surrounding the socket and extending upwardly therefrom. An arm extends upwardly from the support for supporting a generally frusto-conical shade at its upper end. A screen covers the upper opening in the shade, and a wire cage guard extends downwardly from the screen to the upper end of the diffuser.

8 Claims, 1 Drawing Sheet

LAMP WITH GUARD

BACKGROUND OF THE INVENTION

The invention relates to lamps, and more particularly to lamps for institutional use.

In prior art lamps, the lamp socket is generally mounted on a base and is adapted for use with conventional incandescent lamps. If a lamp is removed from the socket, or if the bulb is damaged in the socket, there is a risk of accidental electric shock or laceration. This is a particular problem in institutions for the elderly or emotionally disturbed.

SUMMARY OF THE INVENTION

It is an object of the invention to provide a lamp which is well-suited for institutional use.

It is a further object of the invention to provide a lamp which minimizes the risk of accidental electric shock or laceration.

It is a further object of the invention to provide a lamp which does not readily permit tampering with the lamp socket.

In general terms, the invention comprises a lamp having first support means, a lamp socket mounted on the first support means, a diffuser means mounted on the first support means in surrounding relation to said lamp socket and having an upper opening. Guard means is mounted above the diffuser means and is generally annular and has a lower end disposed adjacent the opening of said diffuser means and being coextensive therewith. Screen means extends across the upper end of the guard means and shade means is coupled to and surrounds the screen means and extends downwardly therefrom and around the guard means and the diffuser means. A second support means extends upwardly from the first support means and within the guard means, and means is provided for selectively fastening the shade means and screen means to the second support means, the guard means being mounted between the screen means and the diffuser means whereby the lamp socket is enclosed by the diffuser means, the guard and the screen means.

The provision of a lamp having a diffuser, a guard, and a screen which cooperate to substantially enclose the lamp socket minimizes the risks of accidental electric shock or laceration from the lamp socket, or a damaged lamp located in the lamp socket.

Further, the provision of means for selectively and releasably fastening the shade, guard and screen, to an upwardly extending arm prevents casual tampering with the light socket, which makes it well-suited for institutional use.

These and other objects and advantages of the present invention will become more apparent from the detailed description hereof taken with the accompanying drawings.

DETAILED DESCRIPTION OF THE PREFERRED EMBODIMENT

Figure 1:
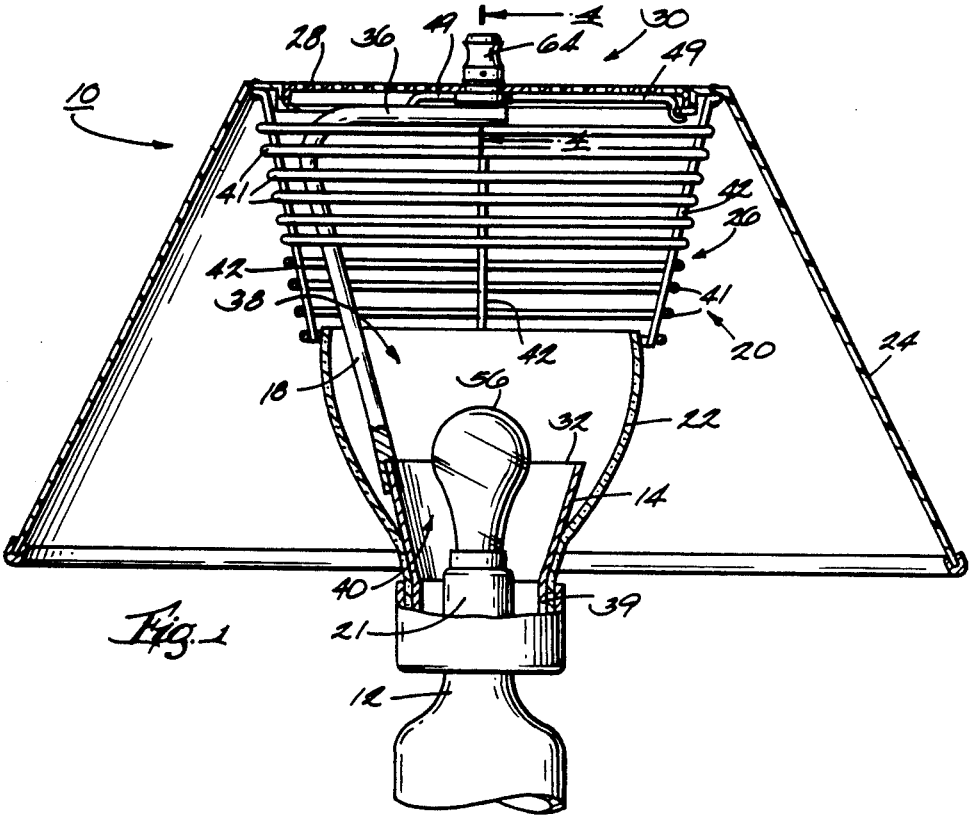
FIG. 1 is a front view, in partial section, of a lamp embodying the invention.
Figure 2:
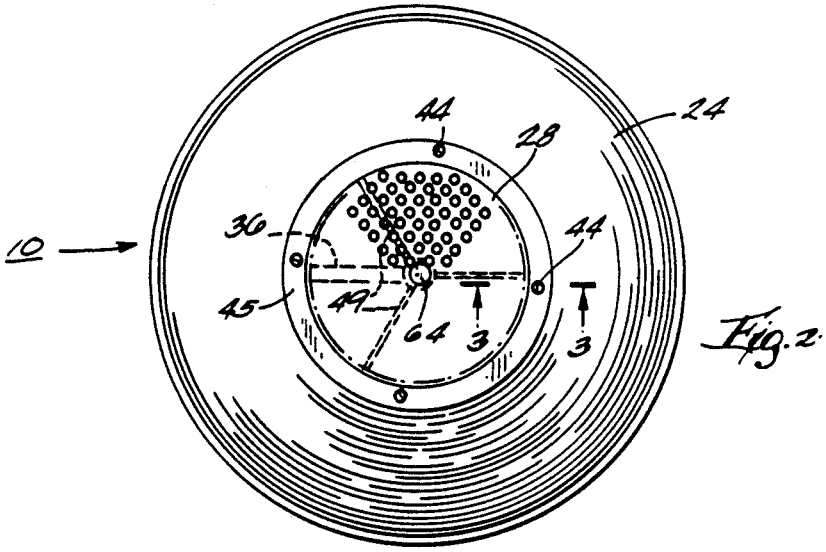
FIG. 2 is a bottom view of the shade employed with the lamp embodying the invention.

The lamp 10 illustrated in FIG. 1 includes a stem 12 for supporting a socket housing 14 and which in turn supports an upwardly extending arm 18. Also supported by the stem is lamp guard means 20 for enclosing a lamp socket 21, and including a diffuser 22, a lamp shade 24, a guard 26, a screen 28, and means 30 for selectively and releasably securing the screen 28 to the arm 18.

The socket housing 14 comprises a cup-shaped member suitably fixed to the upper end of stem 12. The arm 18 may extend upwardly from the socket housing 14, as shown in FIG. 1, and may be fixed thereto in any suitable manner. For example, the lower end of the arm 18 may be forked, with the fingers on each side attached to the cup-shaped member 14 in any suitable manner such as by welding. Preferably, the arm 14 is of a sturdy, heavy-gauge metal for supporting the shade 24, the guard 26, and the screen 28 at its upper end 29.

The diffuser 22 has a generally parabolic upper portion 38 which extends upwardly from the cup-shaped member 14 and an integral lower portion 39 which generally surrounds the cup-shaped member 14 and has an inwardly extending flange (not shown) which is fixed between the upper end of the stem 12 and the under surface of the cup-shaped member 14. While any suitable material may be employed for the diffuser, in the preferred embodiment it may be formed of an opaque, high-strength plastic.

The lamp guard 26 is a generally cylindrical wire cage consisting of a plurality of rings 41 which increase in diameter from bottom to top and which are held in a parallel spaced apart relation by longitudinally extending rods 42. In the preferred embodiment, the lamp guard 26 is supported on the shade 24 by means of eyelets 43 formed at the upper ends of the rods 42. Suitable fasteners, such as rivets 44 extend through eyelets 43 and an inwardly extending flange 45 in the shade 24.

The wire construction of cage 26 allows for the passage of light from a lamp 46 disposed in the lamp socket 16 and also allows for dissipation of heat. Preferably, the wire used for the guard 26 is of a gauge sufficiently heavy to prevent the casual bending of, or tampering with, the guard.

The screen 28 fills the opening in the upper end of the shade 24 and may be supported in any suitable manner. For example, the screen has a wire support affixed to its under surface and including a central ring 48 and radiating wire members 49. A hook 50 at the outer end of members 49 extends around a lip 51 formed at the inner edge of the flange 45. In addition, the screen has a downwardly extending marginal edge 52 which mates with the lip 51. As will be discussed more fully below, the fastening means 30 fixes the screen 28 and shade 24 to the upper end of arm 18. In the preferred embodiment, the screen is made of metal and has openings which are sufficiently large to allow diffusion of light and dissipation of heat from the lamp 56 but which are small enough to prevent tampering with the lamp or the socket 21, such as by poking a finger through an opening in the screen. Further, the screen 28 is preferably made of a gauge of metal sufficiently heavy to prevent the casual bending or penetration.

Figure 4:
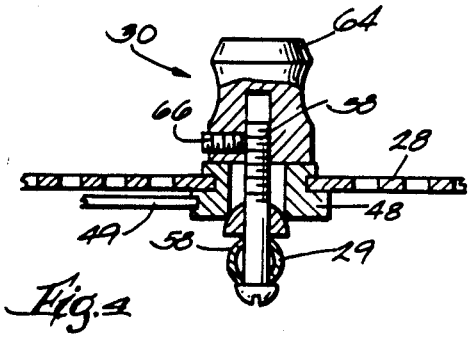
FIG. 4 is a view taken along line 4—4 of FIG. 1.
Figure 3:
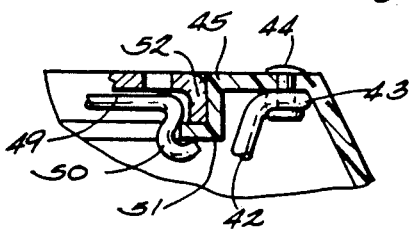
FIG. 3 is a view taken along lines 3—3 of FIG. 2.

As shown in FIG. 4, the means 30 for selectively and releasably fastening the screen 28 to the arm 18 includes a bolt 58 extending through holes formed in the upper, generally horizontal end 29 of arm 18 and the central opening in the ring 48. A nut 64 threadedly engages the bolt 58 for clamping the shade 24 and the screen 28 in position. In the preferred embodiment, the nut 58 includes a set screw 66 for securely fastening the nut 64 on the bolt 46. The set screw 52 insures that the nut 64 can be removed only with the use of a tool and thereby prevents casual removal of the shade 24 and the screen 28.

In the preferred embodiment, the screen 28, the lamp shade 24 and the guard 26 are supported by the arm 18 such that the lower opening of the guard is positioned slightly above and in registry with the upper opening of diffuser 22. The means 30 for fastening the screen 28 to the arm 18 also holds the lamp shade 24 and the guard 26 in place. The guard 26 cooperates with the diffuser 22 and the screen 28 to enclose the lamp socket 21. In the illustrated embodiment, removal of the fastening means 30 allows removal of the shade 24, guard 26, and screen 28 as an integral unit.

While only a single embodiment of the invention has been illustrated and described, they are not intended to be limited thereby, but only by the scope of the following claims.

I claim:

1. A lamp comprising first support means, a lamp socket mounted on said first support means, a diffuser means mounted on said first support means in surrounding relation to said lamp socket and having an upper opening, guard means mounted above said diffuser means, said guard means being generally annular and having a lower end disposed adjacent the opening of said diffuser means and being coextensive therewith, said guard means having an upper end, screen means extending across said upper end of said guard means, shade means coupled to and surrounding said screen means and extending downwardly therefrom and around said guard means and said diffuser means, second support means extending upwardly from said first support means and within said guard means, and means for selectively fastening said shade means and screen means to said second support means, said guard means being mounted between said screen means and said diffuser means whereby said lamp socket is enclosed by said diffuser means, said guard and said screen means.

2. The lamp as set forth in claim 1 wherein said shade means has an upper opening and a lower opening, said upper end of said guard means being registerable with said upper opening of said shade means and wherein said screen means extends across said upper opening of said shade means.

3. The lamp as set forth in claim 2 wherein said guard means is defined by spaced apart wire means forming a lattice.

4. The lamp as set forth in claim 3 wherein said screen means is fixed to said shade means and said means for selectively fastening said screen to said first support means includes a first member extending through first support means and said screen and a second member selectively engageable with said first member.

5. The lamp as set forth in claim 3 wherein said guard means is fixed to said shade means in surrounding relation to the upper opening in said shade means.

6. The lamp set forth in claim 5 wherein said diffuser means is generally parabolic, said guard means is generally an inverted frusto-cone with its small diameter end adjacent the upper opening is said diffuser means and its large diameter end adjacent the screen means.

7. The lamp set forth in claim 6 and including locking means for releasable locking said second member to said first member to prevent the removal of said shade means and said screen means from said second support means.

8. The lamp set forth in claim 7 wherein said second support includes an arm extending upwardly from the first support, said first member being disposed at the upper end of said arm.

* * * * *